United States Patent [19]

James

[11] Patent Number: 4,717,510

[45] Date of Patent: Jan. 5, 1988

[54] ENCAPSULATION OF WASTE MATERIAL

[75] Inventor: John M. James, Weymouth, England

[73] Assignee: United Kingdom Atomic Energy Authority, London, England

[21] Appl. No.: 633,028

[22] Filed: Jul. 23, 1984

[30] Foreign Application Priority Data

Aug. 2, 1983 [GB] United Kingdom ..... 8320841

[51] Int. Cl.[4] ..... G21F 9/34

[52] U.S. Cl. ..... 252/628; 141/329; 250/507.1; 250/506.1; 252/633; 264/0.5; 264/255; 264/267

[58] Field of Search ..... 264/273, 259, 241, 0.5, 264/255, 267; 425/812; 405/266, 267, 269; 141/98, 329, 330, 285, 289, 310; 252/633, 628; 250/506.1, 507.1

[56] References Cited

U.S. PATENT DOCUMENTS

| | | | |
|---|---|---|---|
| 1,883,196 | 10/1932 | Weitz | 405/266 |
| 2,766,484 | 10/1956 | Sanderson | 425/812 |
| 3,067,425 | 12/1962 | Colley | 141/329 |
| 3,133,566 | 5/1964 | Hoss | 141/389 |
| 3,139,123 | 6/1964 | Lisciani | 141/309 |
| 3,448,779 | 6/1969 | Horwitt | 141/98 |
| 3,744,516 | 7/1973 | Rowe | 141/285 |
| 3,749,917 | 7/1973 | Kucherer | 252/633 |
| 3,777,789 | 12/1973 | Corlet | 141/329 |
| 3,897,810 | 8/1975 | Arnett et al. | 141/346 |
| 4,337,167 | 6/1982 | Bird et al. | 252/633 |
| 4,377,509 | 3/1983 | Haynes et al. | 252/633 |
| 4,445,550 | 5/1984 | Davis et al. | 141/329 |

FOREIGN PATENT DOCUMENTS

| | | |
|---|---|---|
| 0552880 | 8/1974 | Switzerland . |
| 1276395 | 6/1972 | United Kingdom . |

*Primary Examiner*—Jan H. Silbaugh
*Assistant Examiner*—Hubert C. Lorin
*Attorney, Agent, or Firm*—William R. Hinds

[57] ABSTRACT

Waste material is encapsulated by charging into a container which is then closed by a cover (11) having filling and vent port means sealed temporarily by a diaphragm (13), such as a metal foil. A nozzle device (20) makes push-fit connections with the port means and ruptures the diaphragm in making the connections. Solidifiable medium is then introduced through the nozzle device and filling port while displaced atmosphere escapes through the vent.

9 Claims, 5 Drawing Figures

ENCAPSULATION OF WASTE MATERIAL

BACKGROUND OF THE INVENTION

According to the present invention, a method of encapsulating waste material, enabling filling of encapsulent to be carried out less restrictively, comprises charging the material into a container through an opening in the container in an environmentally retricted area, closing the openign with a cover having temporarily closed filling and vent port means to isolate the material, transporting the thus closed container to an encapsulating station, there establishing sealed filling and vent connections respectively with the filling and vent port means and causing simultaneously or thereafter the removal of the temporary sealing of the filling and vent port means while otherwise maintaining isolation of the material, and feeding a solidifiable encapsulating medium into the container through the filling connection to fill space in the container unoccupied by the waste material whilst allowing the atmosphere in that space to be displaced from the container through the vent connection exclusively. The closing of the container opening with the temporarily sealed cover implies total closure of the container such that it may then, in accordance with the invention, be transferred to a less restricted area for the filling with encapsulating medium; the temporary sealing in the cover is not removed until the connections for carrying out the filling and venting have been established so that the isolation of the container contents is maintained.

Advantageously the operation of a connector means to establish the filling and vent connections is effective to remove the temporary sealing so that such removal is not only accomplished in one single operation but is also prevented from occurring prematurely.

It is also advantageous that the connector means should be sacrificial, that is to say, left in place to become an integral part of the resulting monolithic block. To this end, the connector means is conveniently a unitary nozzle having separate passages connectable on the one hand to the filling and vent port means and on the other hand to feed and vent lines; from the latter, the unitary nozzle should be readily detachable so as to be retainable sacrifically in the ports. The filling of the container with the encapsulating medium is continued to the point of ensuring that the nozzle is internally occupied substantially fully by the medium so that on solidification the interior of the nozzle is plugged.

In terms of apparatus, the invention provides a lid or cover by which to close a container holding waste material, such lid having filling and vent port means adapted for the making thereto of a filling connection for the introduction of encapsulating medium and a vent connection for the release of displaced atmosphere, and temporary sealing of the filling and vent port means which is removable simultaneously with or subsequent to the making of the connections. The temporary sealing may be diaphragm arranged to be ruptured by filling and venting nozzle means or similarly may be a disc which such nozzle means can dislodge and eject in being brought into its connected position.

DESCRIPTION OF THE DRAWINGS

The invention is more fully disclosed and described below with reference to the accompanying drawings, in which.

DESCRIPTION OF THE PREFERRED EMBODIMENTS

Figure 1:
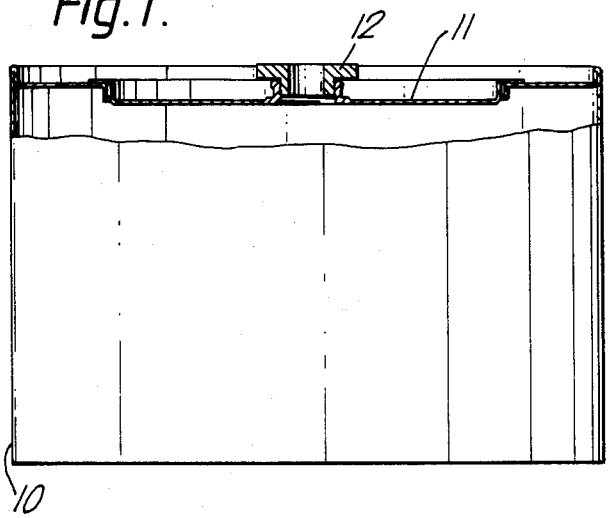
FIG. 1 is a sketch axial sectional view of a drum-shaped cylindrical container.

As shown in FIG. 1, a drum-shaped cylindrical container 10 has an opening which, after charging of the container, for example with waste material, may be closed by a circular flanged lid or cover 11 which, suitably, is a press fit in the opening though it may be a screw closure if the opening 10*a* and the rim of the lid 11 are formed with suitable threads. The waste material placed in the container may be in the form of radioactive solid objects, whether scraps, pieces, or even artefacts for disposal, or in the form of bulk solids, such as spent filter material. At its centre, the lid 11 is pre-fitted before use with a screw-in adaptor or boss 12 leaving an opening which (see FIG. 2) initially is covered, and therefore sealed, by a planar skin or diaphragm 13 of metallic foil, this diaphragm being affixed over an inwardly directed annular face of the boss.

A feed line 14 for the introduction of encapsulating medium has an end fitting 15. Formed in this end fitting at its extremity is an annular groove 16 encircling a central channel 17 through which a flow of the medium takes place. A bore 18 connects this groove with a tubular side arm 19 which connects to a vent line (not shown).

For making connections to the feed and vent lines a nozzle device of plastics material 20 has an annular projection 20*a* for insertion with a push fit into the groove 16 of the end fitting 15. In this annular projection are several longitudinally extending bores 21 arranged in a ring at regular intervals to make a vent connection with the vent line connector 19. Also forming part of the device 20, and projecting in the other direction, is a nozzle 22 through which extends a central filling passage 22*a* communicating with the channel 17 of the fitting 15 when the nozzle device 20 is fitted thereto.

On its outer surface, the nozzle device has two circumferentially extending grooves 23 and 24 to co-operate with an annular lug 25 in the boss 12 with a snap lock action. Thus, when filling is to commence, the nozzle device 20, having been previously push fitted on the end fitting 15 of the filling line, is first driven into the boss 12 to snap the lug 25 into the first groove 23 thereby holding the nozzle device in the boss and forming a seal which is proof against escape of contamination. Further pressure on the nozzle device to increase the penetration into the boss causes a second snap lock to be reached when the lug 25 snaps into the second groove 24 and in reaching this position (indicated in broken outline) the advancing tip of the nozzle 22 ruptures the diaphragm 13, the contamination-proof seal having been maintained by the contact of the deformable plastic nozzle device with the inner surfaces of the boss. The snap lock arrangement may of course be the opposite of that illustrated, i.e. with the grooves in the boss and the lug on the nozzle device.

Cement used as an encapsulating medium can then be fed into the container, and air thereby displaced is allowed to proceed to the vent line connector 19 through the bores 21, the groove 16 and the bore 18. The flow of cement will tend to deflect into the container the fragments of ruptured diaphragm 13 to give free egress of contained atmosphere to the vent line and by this line to an absolute filter system (not shown). The filling with cement is continued until the nozzle device, including the passages 21, is also filled. At this point the feed line may be withdrawn, detachment of the end fitting taking place readily from the nozzle device which is therefore sacrificially left in place. As a final step, if desired, a cap may be placed over the upwardly projecting end of the nozzle device.

It will be appreciated that the opening in the boss sealed initially by the diaphragm 13 combines the functions of filling and vent ports. Likewise that the nozzle device embodies unitarily the separate passages for connecting with this dual function opening.

Figure 3:
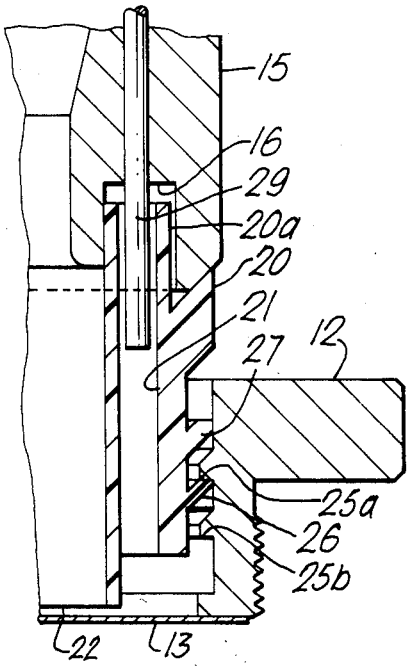
FIG. 3 is a scrap view, similar to part of FIG. 2, showing a modified filling and venting nozzle in a first fitted position thereof.
Figure 4:
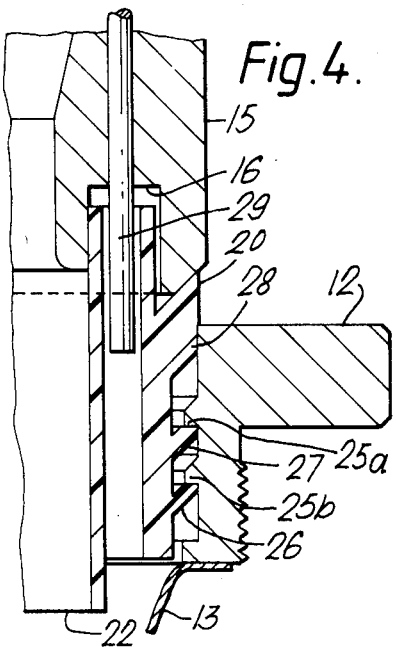
FIG. 4 is a scrap view like FIG. 3 but showing the modified filling and venting nozzle in a second fitted position thereof.
Figure 2:
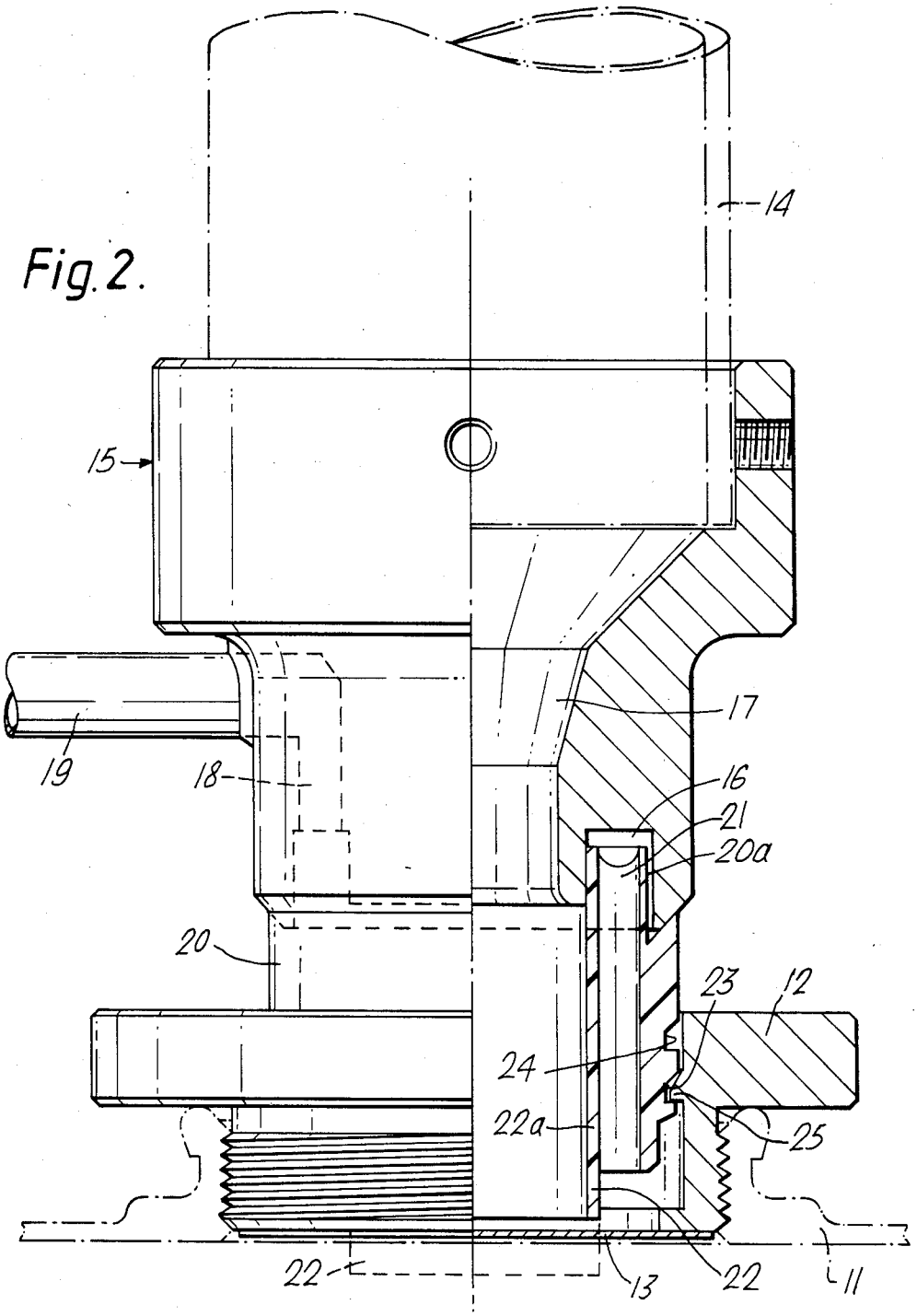
FIG. 2 is a view, on a larger scale and partly in axial section, of temporarily sealed filling and venting means for a lid or cover of the container shown in FIG. 1, and of a filling and venting nozzle means fitted thereto and to a movable feed and vent line assembly therefor.

FIGS. 3 and 4 show a slightly modified boss 12, formed with two annular ribs 25*a* and 25*b* for co-operation with two resiliently projecting annular flanges 26 and 27 of a nozzle device 20 which is, thus, also slightly modified as compared in FIG. 2. As shown in FIG. 3, the nozzle device 20, fitted to the end fitting 15, is inserted into the boss 12 to a first position in which it is retained by a snap lock engagement of the resilient flange 26 behind the annular rib 25*a*. When the nozzle device 20 is pushed further, into a second engaged position as shown in FIG. 4, its forward end 22 ruptures the diaphragm 13 and its flanges 26 and 27 both become engaged by the two annular ribs 25*a* and 25*b*, to provide two ring seals therewith. Furthermore, in this modified form, the nozzle device 20 is given a slightly increased maximum diameter such that, in this second position, it is an interference fit in the boss 12 which deforms it at the region 28 to form a third ring seal.

FIGS. 3 and 4 also show a modification in the end fitting 15, namely the provision within its annular groove 16 of a level-sensing probe 29 which, as each nozzle device 20 is fitted to the end fitting 15, is accommodated in one of the bores 21 thereof and, as filling of the container is completed, senses the rising surface level of the filling medium in the bore 21 and thereupon generates a signal which is employed to terminate automatically the feed of filling medium through the feed line 14 prior to removal of the end fitting 15 from the nozzle device 20 which is sacrificed and remains secured in the boss 12 and substantially filled with the filling medium which then solidifies.

Figure 5:
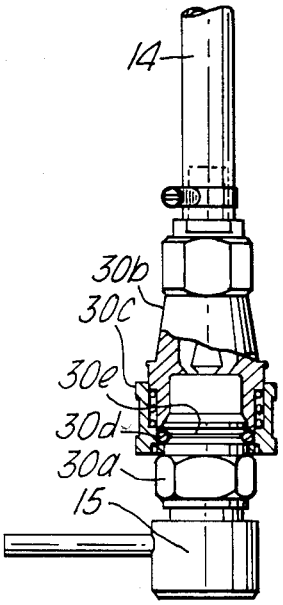
FIG. 5 is a view, on a smaller scale than FIG. 2 and partly in axial section, of a modified feed and vent line assembly.

FIG. 5 shows a further modification in which the end fitting 15 is secured on the feed line 14 by a two-part separable "Hansen" coupling havign a part 30*a* on which the end fitting 15 is secured, a part 30*b* which is secured on the feed line 14, and a sleeve 30*c* slidable and spring-urged downwards (in FIG. 5) on the part 30*b* but movable upwards against the spring-urging to allow captive retainer balls 30*d* to disengage from a groove 30*e* in the part 30*a* and thereby allow the latter to separate from the part 30*b*. This enables a rapid check to be made, before the end fitting 15 is removed from the nozzle device 20, to confirm that the end fitting has not become radioactively contaminated during filling of the container. If a lack of contamination is confirmed, the part 30*a* may be re-fitted to the part 30*b* and the end fitting removed from the nozzle device 20. If, on the other hand, contamination of the end fitting 15 should prove to have occurred, it (and the coupling part 30*a*) may be left temporarily attached to the nozzle device 20 while the container is removed for a special decontamination procedure to be carried out, the contaminated end fitting 15 and attached coupling part 30*a* being replaced on the coupling part 30*b* by duplicates to allow filling of further containers to continue without delay.

I claim:

1. A method of encapsulating waste material enabling filling of encapsulant to be carried out less restrictedly which comprises charging the material into a container through an opening in the container in an environmentally restricted area, closing the opening with a cover having temporarily sealed filling and vent port means to isolate the material, transporting the thus closed container to an encapsulating station, there establishing sealed filling and vent connections respectively with the filling and vent port means and causing simultaneously or thereafter the removal of the temporary sealing of the filling and vent port means while otherwise maintaining isolation of the material, and feeding a solidifiable encapsulating medium into the container through the filling connection to fill space in the container unoccupied by the waste material whilst allowing the atmosphere in that space to be displaced from the container through the vent connection exclusively.

2. A method as claimed in claim 1 including establishing the filling and vent connections by fitting connector means with sealing engagement to the filling and vent port means, said fitting of the connector means removing the temporary sealing of the filling and vent port means.

3. A method as claimed in claim 2 in which the connector means is sacrificial, being readily detachable from feed and vent lines, and the filling of the container with solidifiable encapsulating medium from the feed line is continued to the point of ensuring that the connector means is internally occupied substantially fully by such medium so that on solidification the connector means becomes an integral and plugged part of the filled container.

4. A method as claimed in claim 1 in which the solidifiable encapsulating medium employed is a cement.

5. A method as claimed in claim 1 wherein the waste material is radioactive waste.

6. A method as claimed in claim 2 wherein the filling and vent port means is a single port in the cover, and the connector means includes a filling connection for the encapsulating medium and a vent connection for sealed communication with a vent line.

7. A method as claimed in claim 6 wherein the temporary seal of the single port is by a rupturable diaphragm which is ruptured by said connector means.

8. A method as claimed in claim 7 wherein the connector means is sacrificial, being readily detachable from feed and vent lines, and the filling of the container with solidifiable encapsulating medium from the feed line is continued to the point of ensuring that the connector means is internally occupied substantially fully by such medium so that on solidification the connector means becomes an integral and plugged part of the filled container.

9. A method as claimed in claim 8 wherein said encapsulating medium, as fed into the container, is a solidifiable flowable liquid medium selected from cement, bituminous materials and resinous materials.

* * * * *